US009097495B1

(12) United States Patent
Kesterson

(10) Patent No.: US 9,097,495 B1
(45) Date of Patent: Aug. 4, 2015

(54) ARMOR APPARATUS AND METHOD

(71) Applicant: Commercial Metals Company, Irving, TX (US)

(72) Inventor: William Kesterson, Riverside, AL (US)

(73) Assignee: Commercial Metals Company, Irving, TX (US)

( * ) Notice: Subject to any disclaimer, the term of this patent is extended or adjusted under 35 U.S.C. 154(b) by 0 days.

(21) Appl. No.: 14/289,022

(22) Filed: May 28, 2014

Related U.S. Application Data

(60) Provisional application No. 61/828,762, filed on May 30, 2013.

(51) Int. Cl.
*F41H 5/04* (2006.01)
*F41H 5/24* (2006.01)
*E04H 9/04* (2006.01)

(52) U.S. Cl.
CPC .. *F41H 5/04* (2013.01); *E04H 9/04* (2013.01); *F41H 5/24* (2013.01)

(58) Field of Classification Search
CPC ..... F41C 5/02; F41C 5/023
USPC ..... 89/36.01, 36.02, 36.04–36.06, 89/36.11–36.15; 114/9–14; 109/49.5; 428/911
See application file for complete search history.

(56) References Cited

U.S. PATENT DOCUMENTS

| | | | | |
|---|---|---|---|---|
| 2,393,350 | A * | 1/1946 | Wiedman | 109/49.5 |
| 4,981,067 | A * | 1/1991 | Kingery | 89/36.17 |
| 5,007,326 | A | 4/1991 | Gooch, Jr. et al. | |
| 5,601,895 | A * | 2/1997 | Cunningham | 428/66.6 |
| 2014/0013934 | A1 | 1/2014 | Inglefield et al. | |

OTHER PUBLICATIONS

Howell, R. A. et al., "Advancements in Steel for Weight Reduction of P900 Armor Plate," Survivability Materials Branch, Army Research Lab.

* cited by examiner

*Primary Examiner* — Reginald Tillman, Jr.
(74) *Attorney, Agent, or Firm* — Haynes and Boone, LLP

(57) ABSTRACT

An armor apparatus and associated methods are described. In an exemplary embodiment, the armor apparatus is a laminate armor apparatus that includes two or more plates. In several exemplary embodiments, slots are formed through each of the two or more plates.

28 Claims, 11 Drawing Sheets

ARMOR APPARATUS AND METHOD

CROSS-REFERENCE TO RELATED APPLICATION

This application claims the benefit of the filing date of, and priority to, U.S. patent application No. 61/828,762, filed May 30, 2013, the entire disclosure of which is hereby incorporated herein by reference.

BACKGROUND

This disclosure relates in general to armor and, in particular, to a laminate armor apparatus and methods associated with same. In several exemplary embodiments, the laminate armor apparatus includes two or more plates connected together, with each plate having a plurality of slots formed therethrough.

DETAILED DESCRIPTION

Figure 1:
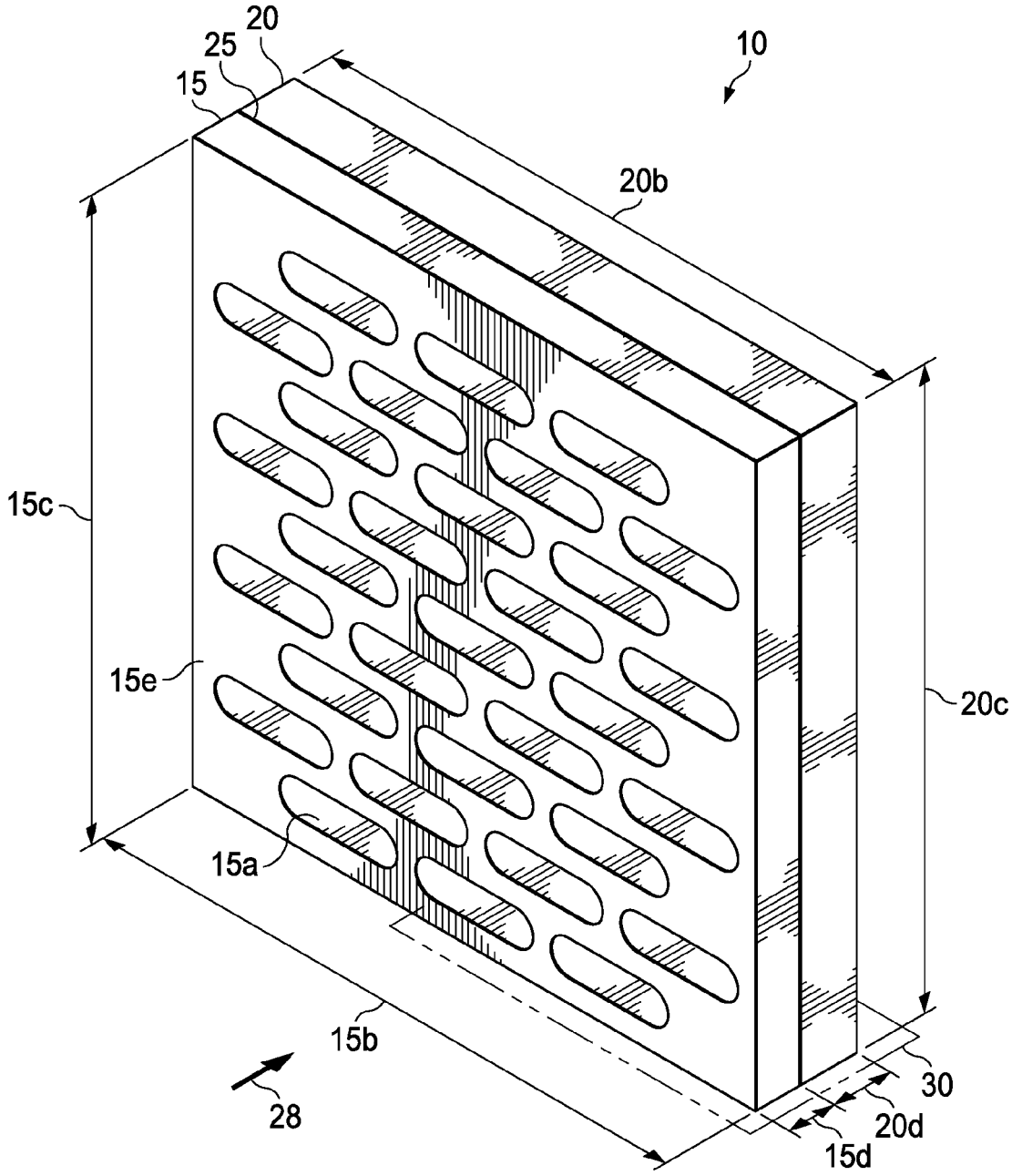
FIG. 1 is a perspective view of an armor apparatus, according to an exemplary embodiment.

In an exemplary embodiment, as illustrated in FIGS. 1, 2, 3, 4, and 5, an armor apparatus is generally referred to by the reference numeral 10 and includes a front plate 15 through which a plurality of slots 15*a* is formed. A back plate 20 through which a plurality of slots 20*a* is formed is connected to the front plate 15. In an exemplary embodiment, an adhesive 25 adheres the front plate 15 to the back plate 20. As will be described in further detail below, the armor apparatus 10 is configured to protect a structure, or substrate. Specifically, upon impacting the armor apparatus 10, a projectile (not shown) approaching from a direction indicated by an arrow 28 will fracture into fragments thereby preventing or reducing damage to the structure protected by the armor apparatus 10. Since the armor apparatus 10 includes at least two plates, it may be characterized as laminated armor, an armor laminate, or a laminate armor system or apparatus.

In an exemplary embodiment, the front plate 15 is composed of an armor material. In an exemplary embodiment, the front plate 15 is composed of thick ultra-high hard armor ("UHHA"). However, a variety of armor materials may be used, such as for example, high hard armor ("HHA"), rolled homogenous armor ("RHA"), one or more other materials, one or more combination(s) of materials, or any combination thereof. In an exemplary embodiment, the front plate 15 has a length 15*b*, a height 15*c*, and a thickness, or depth 15*d*. In an exemplary embodiment, the length 15*b* is approximately 4.25 inches, the height 15*c* is approximately 4.25 inches, and the depth 15*d* is approximately 0.25 inches. However, a variety of values for the length 15*b*, the height 15*c*, and the depth 15*d* are contemplated here. In alternative embodiments, the front plate 15 can be modified or customized to have any value for the length 15*b*, the height 15*c*, and the depth 15*d*. In one embodiment, each of the slots 15*a* is oblong in shape and has a length of approximately 0.875 inches and a height of approximately 0.25 inches. In alternative embodiments, the slots 15*a* may have any dimension or shape such as, for example, a circular, a rectangular, an oval, or an oblong shape. In an exemplary embodiment, each of the slots 15*a* has a center axis 15*a*' (shown in FIG. 5) that is perpendicular to a front face 15*e* of the front plate 15. That is, a surface forming each slot in the plurality of slots 15*a* forms a right angle with the front face 15*e* of the front plate 15. In one embodiment, the slots 15*a* are formed in the front plate 15 in a pattern. That is, the shapes and dimensions (size) of the slots 15*a* are identical, a vertical spacing (along the height 15*c*) between any two adjacent slots 15*a* is repetitive, and a horizontal spacing (along the length 15*b*) between any two adjacent slots 15*a* is repetitive. For example and in one embodiment, thirty-one (31) slots 15*a* are formed within the front plate 15, which has an area of about 18 square inches. Within the area of about 18 square inches, the thirty-one (31) slots 15*a* are arranged in 9 rows, such that a first, third, fifth, and seventh row (with the first row towards the top of the front plate 15) contain three (3) slots 15*a* and a second, fourth, sixth, and eight row contain four (4) slots 15*a*. Along the length 15*b*, the horizontal spacing between any two adjacent slots 15*a* is uniform while along the height 15*c*, the vertical spacing between any two adjacent rows is uniform. In an exemplary embodiment, a lower surface of the slots 15*a* that is located on the ninth row and that extends along the length 15*a*, also extends within a reference plane 30 (shown in FIGS. 1, 2, and 3). If the area is greater than about 18 square inches, the pattern may be repeated and if the area is less than about 18 square inches, the number of rows or the amount of slots included in each row may be reduced. That is, the number of slots and rows may be added or removed from the pattern to accommodate different dimensions of the front plate 15*a*.

Figure 2:
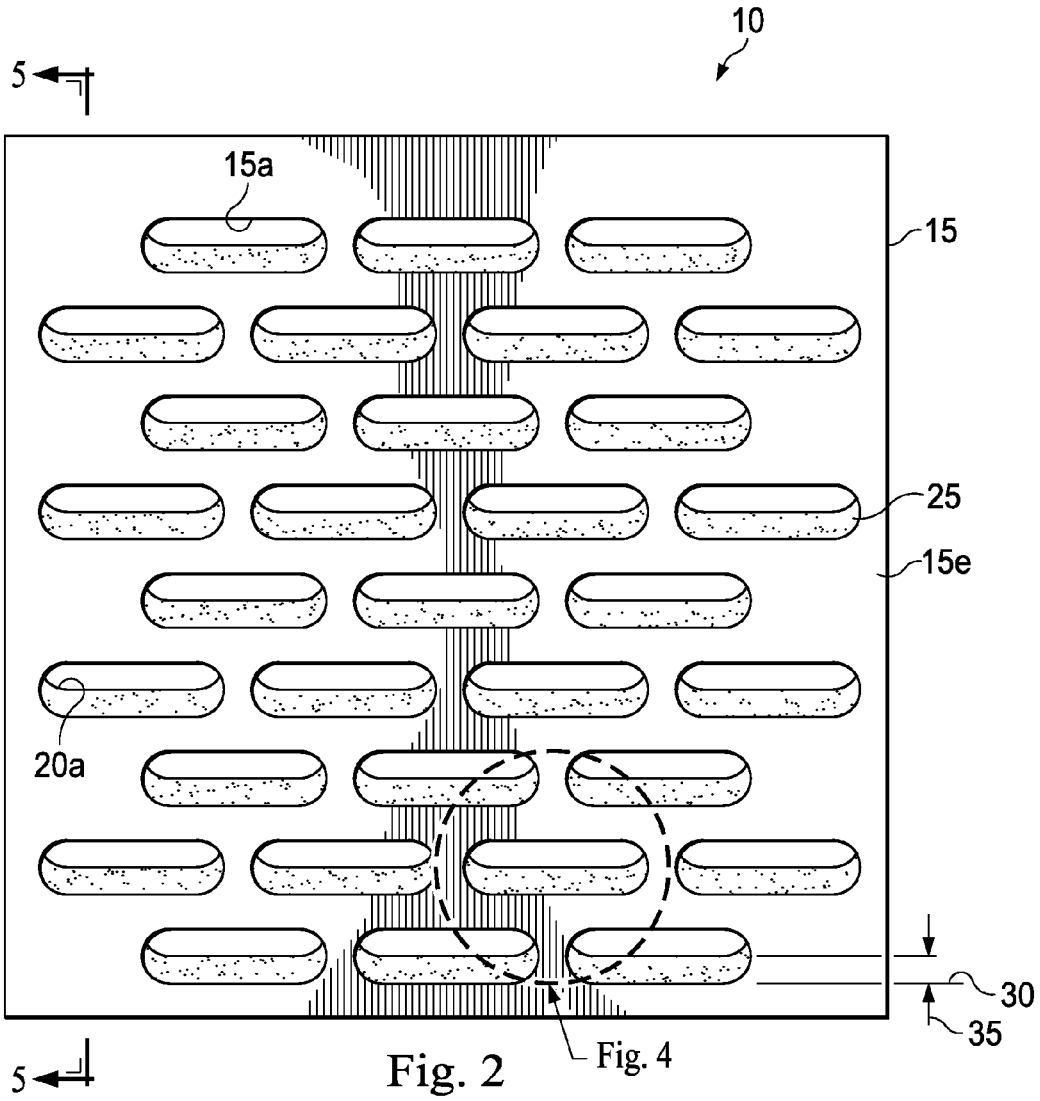
FIG. 2 is a front view of the armor apparatus of FIG. 1, according to an exemplary embodiment.
Figure 3:
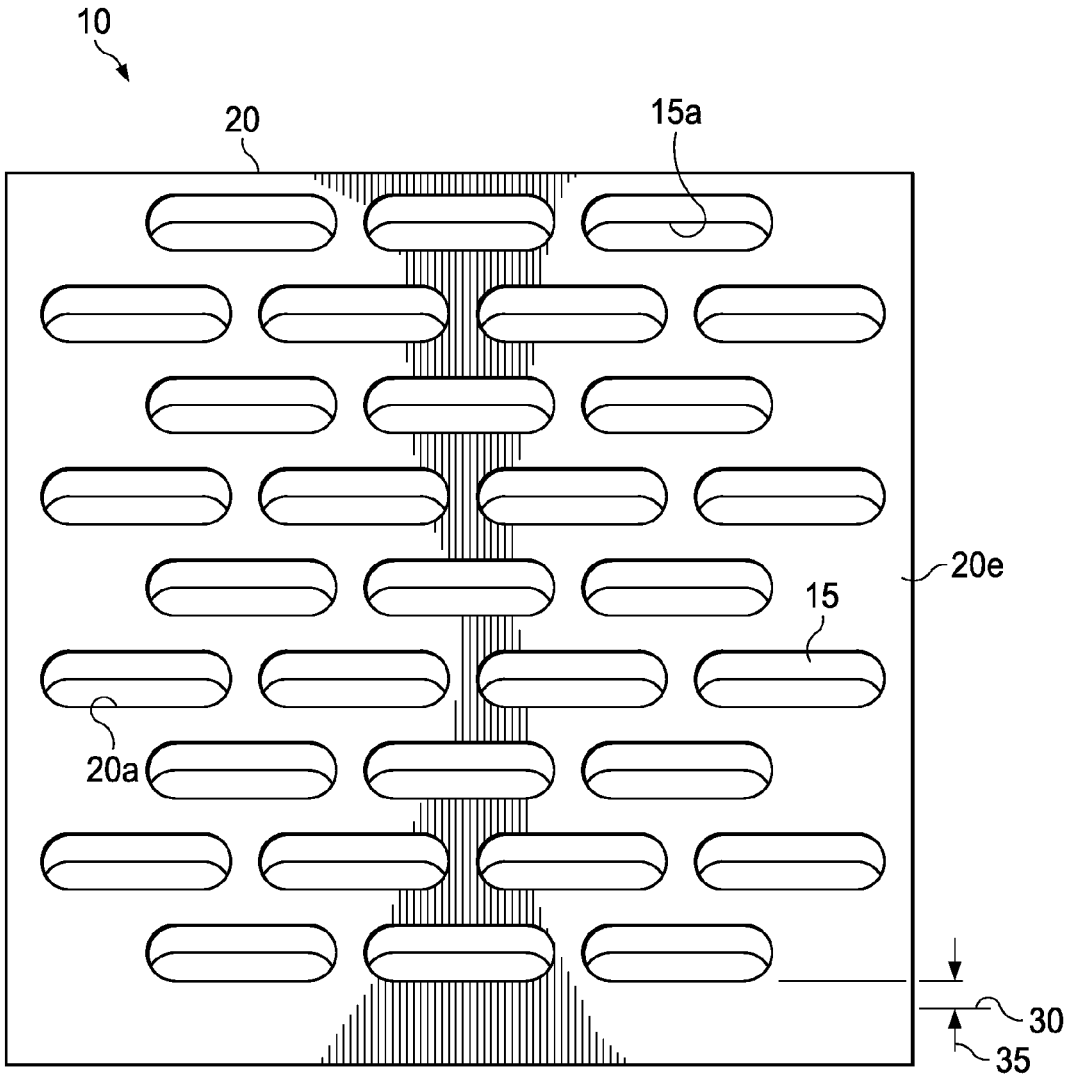
FIG. 3 is a back view of the armor apparatus of FIGS. 1 and 2, according to an exemplary embodiment.

In an exemplary embodiment, the back plate 20 is composed of an armor material. In an exemplary embodiment, the back plate 20 is composed of HHA. However, a variety of armor materials may be used, such as for example, UHHA, RHA, one or more other materials, one or more combination (s) of materials, or any combination thereof. In an exemplary embodiment, the back plate 20 has a length 20*b*, a height 20*c*, and a thickness, or depth 20*d*. In an exemplary embodiment, the length 20*b* is approximately 4.25 inches, the height 20*c* is approximately 4.25 inches, and the depth 20*d* is approximately 0.375 inches. However, a variety of values for the length 20*b*, the height 20*c*, and the depth 20*d* are contemplated here. In alternative embodiments, the back plate 20 can be modified or customized to have any value for the length 20*b*, the height 20*c*, and the depth 20*d*. In one embodiment, each of the slots 20*a* is oblong in shape and has a length of approximately 0.875 inches and a height of approximately 0.25 inches. In alternative embodiments, each of the slots 20*a* can have any dimensions or shape such as, for example, a circular, a rectangular, an oval, or an oblong shape. In an exemplary embodiment, each of the slots 20*a* has a center axis 20*a*' (shown in FIG. 5) that is perpendicular to a back face 25*e* of the back plate 20. That is, a surface forming each slot in the plurality of slots 20*a* forms a right angle with the back face 20*e* of the back plate 20. In one embodiment, the slots 20*a* are formed in the back plate 20 in a pattern. In an exemplary embodiment, the pattern formed in the back plate 20 is identical to the pattern formed within the front plate 15. Accordingly, the pattern formed in the back plate 20 includes thirty-one (31) slots 20*a* that are arranged in 9 rows, such that a first, third, fifth, and seventh row (with the first row towards the top of the back plate 20) contain three (3) slots 20*a* and a second, fourth, sixth, and eight row contain four (4) slots 20*a*. However in an exemplary embodiment and as best illustrated in FIGS. 2 and 3, a lower surface of the slots 20*a* that is located on the ninth row and that extends along the length 20*a* is offset from the plane of reference 30 by an offset distance 35. As the patterns formed within the front plate 15 and the second plate 20 are identical in an exemplary embodiment, each of the slots 15*a* is vertically offset by the distance 35 from its corresponding slot 20*a*. That is, the first plate is connected to the second plate such that the pattern of the first plurality of slots 15*a* is vertically offset by the distance 35 from the pattern of the second plurality of slots 20*a*.

Figure 4:
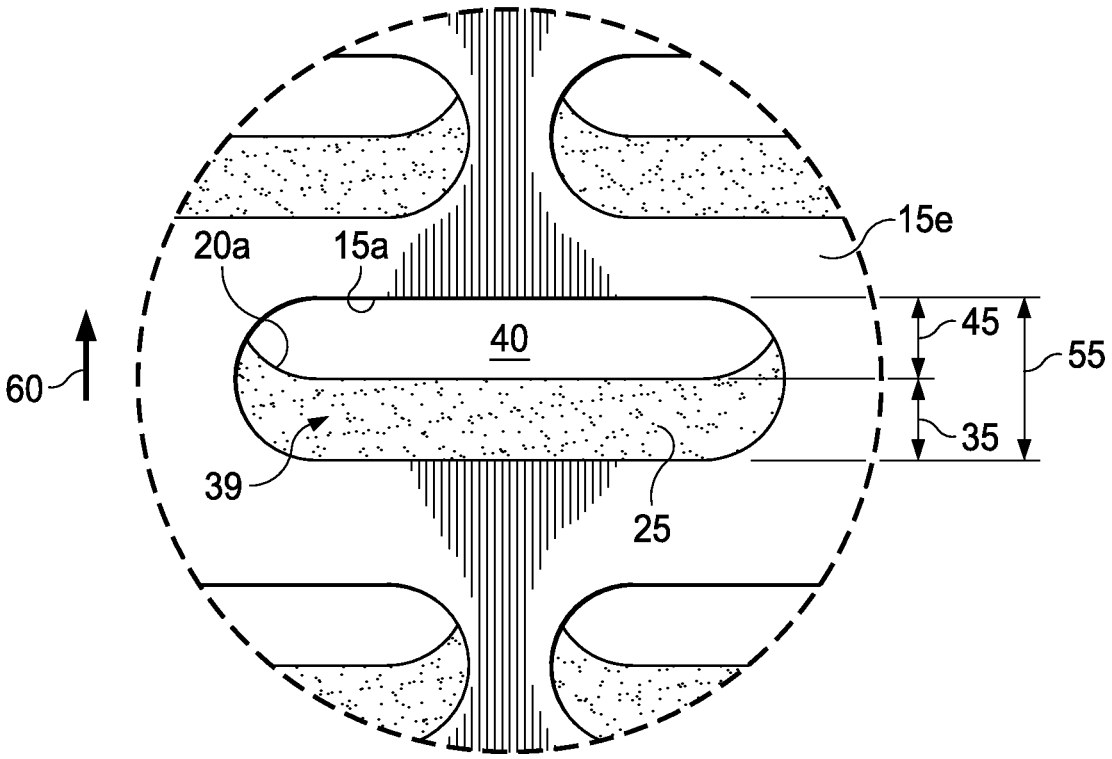
FIG. 4 is an enlarged view of a portion of FIG. 2, according to an exemplary embodiment.

According to certain embodiments, the front plate 15 and the back plate 20 are connected by the adhesive 25 (or bonding material), which is disposed between the plates 15 and 20. In an exemplary embodiment, the adhesive 25 may be applied to a front face of the back plate 20 and/or to a back face of the front plate 15. In an exemplary embodiment and as shown in FIGS. 2 and 4, the adhesive 25 is applied to and covers the front face of the back plate 20. In an exemplary embodiment, the adhesive 25 is composed of an epoxy adhesive. In an exemplary embodiment, the adhesive 25 is composed of an epoxy laminate adhesive. Examples of suitable epoxy laminate adhesives include XP8740, L5505, L5573, and L8107 laminates, or combinations thereof, which are commercially available from L&L Products, Romeo, Mich. In an exemplary embodiment, the adhesive 25 has a very high strain ratio. In an exemplary embodiment, the adhesive 25 resists the individual armor plates 15 and 20 from separating during impact, reduces crack propagation in the plates 15 and 20 at impact, and forces the various layers of steel (plates 15 and 20) to act as a solid composite system. Instead of, or in addition to the adhesive 25, the front plate 15 and the back plate 20 can be connected together by fasteners (not shown), a brazed connection, one or more weldments, one or more other types of connections, or any combination thereof.

Figure 5:
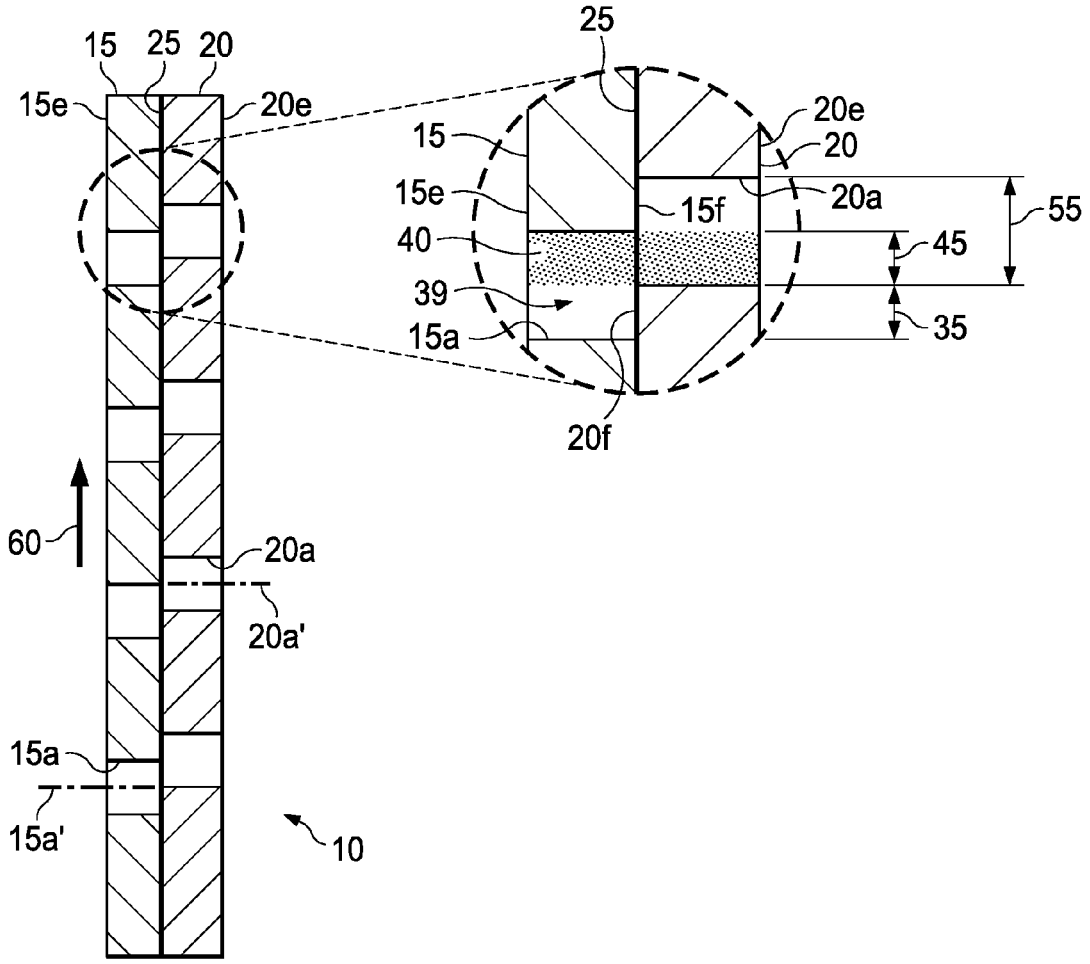
FIG. 5 is a sectional view of the armor apparatus of FIGS. 1-4 taken along line 5-5 of FIG. 2, according to an exemplary embodiment.

As shown in FIGS. 4 and 5, each of the slots 15*a* of the front plate 15 is partially aligned, or intersects, with a corresponding slot in the plurality of slots 20*a* of the back plate 20 to form openings 39 that extend through the front plate 15 and the back plate 20. In an exemplary embodiment, a passage 40 (indicated by a shaded area 40 in FIG. 5) extends within the opening 39. In an exemplary embodiment, the passage 40 is a longitudinally-extending passage 40. In an exemplary embodiment and as shown in FIG. 5, the opening 39 has a stair-step profile. That is, a portion of the back plate 20 extends over the slots 15*a* to form a plurality of back plate shoulders 20*f*. Similarly, a portion of the front plate 15 extends over the slots 20*a* to form a plurality of front plate shoulders 15*f*. In an exemplary embodiment, the center axis 15*a*' of one slot in the plurality of slots 15*a* is parallel to and offset from the center axis 20*a*' of a corresponding one slot in the plurality of slots 20*a*. In an exemplary embodiment and as shown in FIGS. 4 and 5, when the front plate 15 and the back plate 20 are connected, the passage 40 has a height 45. In certain embodiments, each of the slots 15*a* and 20*a* has a height 55 of approximately 0.25 inches and the offset 35 is approximately 0.125 inches. Therefore, each passage 40 has a height 45 of approximately 0.125 inches. Thus, the offset 35 is 50% of the height 55. In alternative embodiments, the height 55 and the offset 35 may have any variety of values. In certain embodiments, the offset 35 is approximately 50% of the height 55 of the slots 15*a* and 20*a*. In alternative embodiments, the offset 35 may be any percentage of the height 55 of slots 15*a* and 20*a*, from greater than 0% to more than 100%. In certain embodiments, the offset 35 may be less than 50%, greater than 50%, or greater than 100%, of the height 55. In connection with FIGS. 4 and 5, the term "height" refers to any dimension along the direction indicated by an arrow 60. As shown in FIG. 5, when the front plate 15 and the back plate 20 are connected, one of the slots 15*a* on the front plate 15 partially aligns with a corresponding slot in the plurality of slots 20*a* to form the opening 39 that has a stair-step profile. In an exemplary embodiment, one of the back plate shoulders 20*f* obstructs a portion of a corresponding one of the slots 15*a* to form the stair-step profile. In an exemplary embodiment, one of the front plate shoulders 15*f* obstructs a portion of the corresponding one of the slots 20*a* to form the stair-step profile. In an exemplary embodiment, each of the back plate shoulders 15*f* and 20*f* are formed from right angles.

Figure 6:
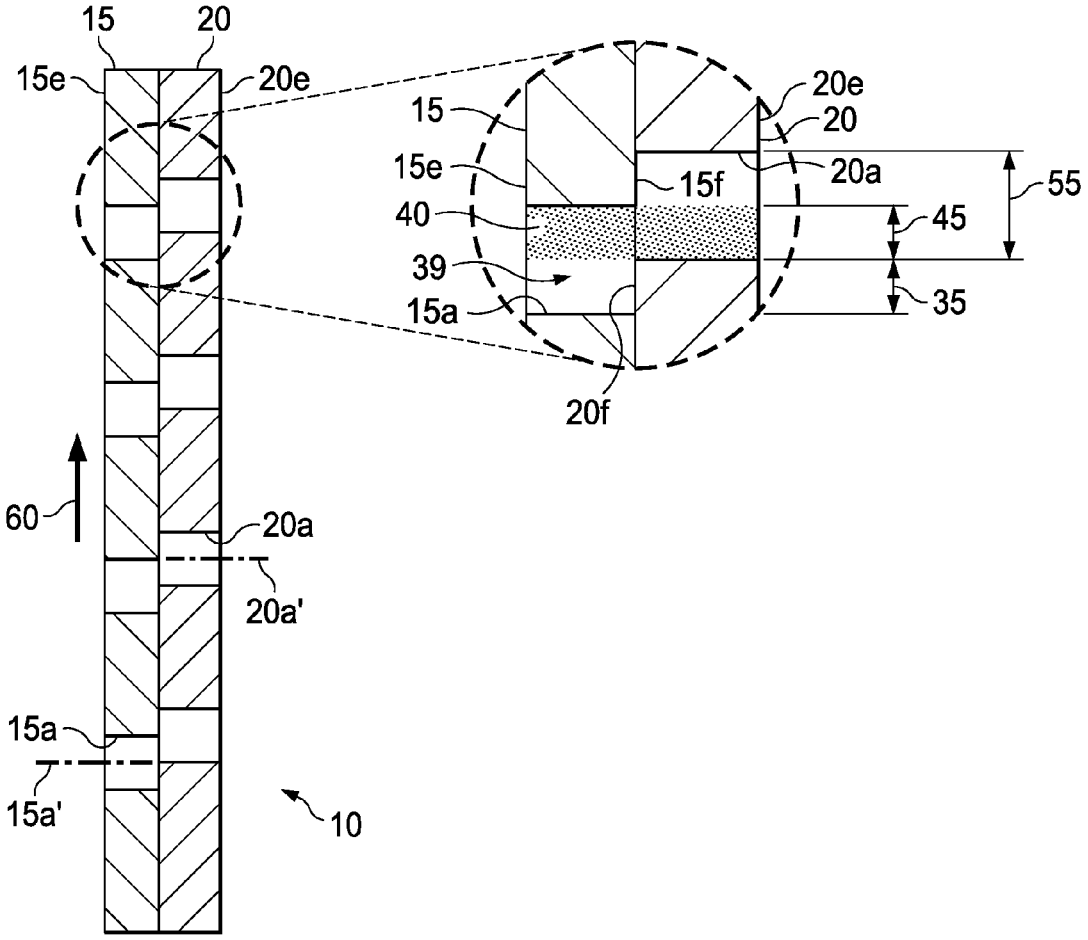
FIG. 6 is a sectional view of the armor apparatus of FIG. 1, according to another exemplary embodiment.
Figure 7:
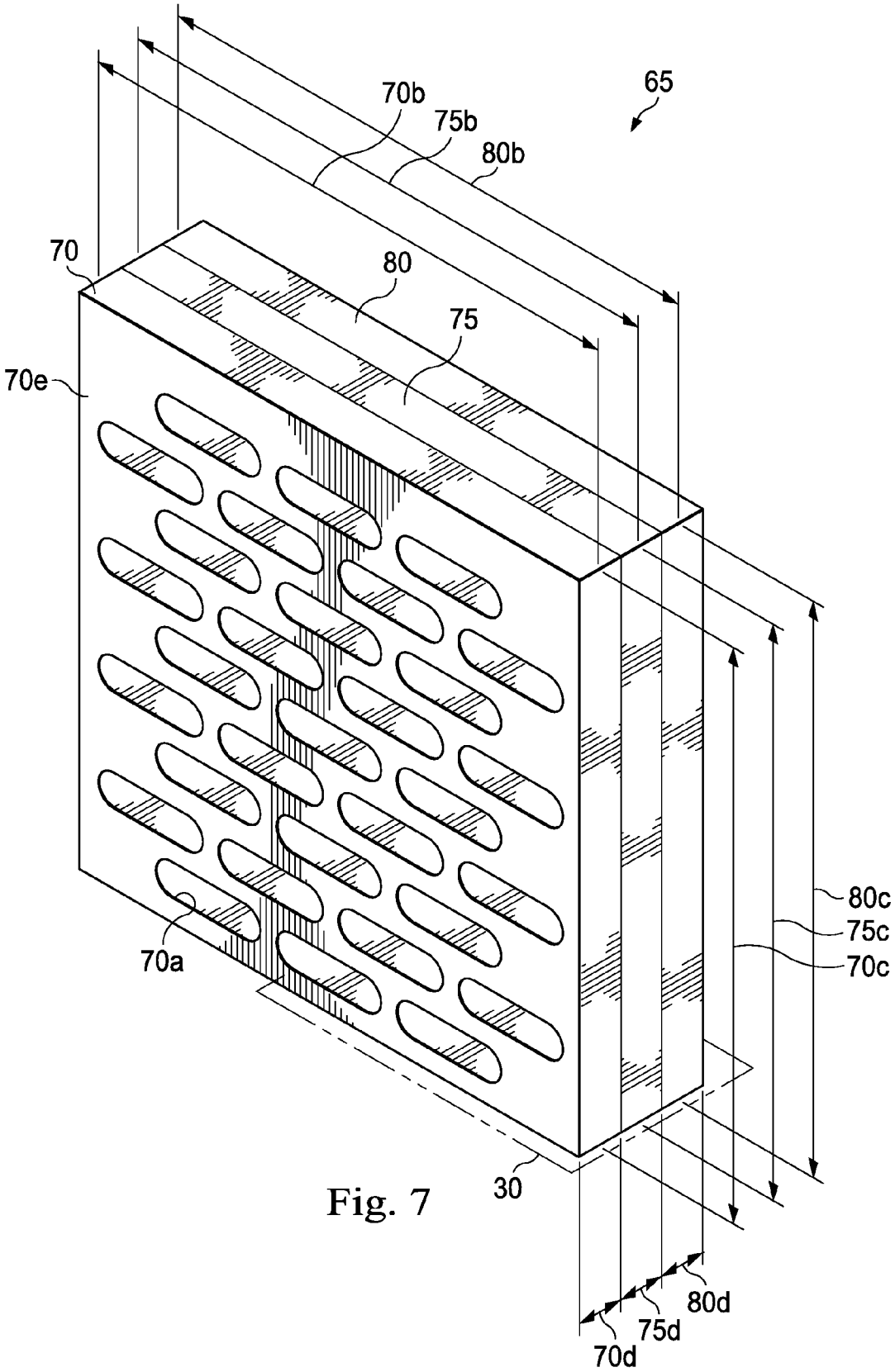
FIG. 7 is a perspective view of an armor apparatus, according to another exemplary embodiment.

In some embodiments, and as shown in FIG. 6, the adhesive 25 is omitted. In an exemplary embodiment and when the adhesive is omitted, the front plate 15 and the back plate 20 are connected in a variety of ways such that the back face of the front plate 15 is in contact with the front face of the back plate 20. For example, the front plate 15 may be attached to the back plate 20 using welds, brazing techniques, heat shrinking methods, one or more types of fasteners, etc. Thus, the disclosure is not limited to a particular configuration for connecting the front plate 15 to the back plate 20. In one embodiment, the front plate 15 and the back plate 20 each includes four holes that are located in each corner of the front plate 15 and the back plate 20, respectively. Each hole is a circle with a diameter of approximately 0.313 inches. The holes permit fasteners to extend therethrough to connect the front plate 15 to the back plate 20. In alternative embodiments, the holes may have any shapes or dimensions, or may be omitted. In one embodiment, fasteners extend through the holes to connect the armor apparatus 10 to a test fixture or to the protected substrate.

In operation, in several exemplary embodiments, the armor apparatus 10 operates to protect a structure or substrate (not shown) which may be exposed to a threat, such as a projectile (not shown). Substrates or structures suitable for protection include tanks, trucks, personal vehicles, airplanes, helicopters, boats, fortified structures, and humans. The armor apparatus 10 is placed over the substrate to be protected, and the armor apparatus 10 acts as a barrier between the substrate and the threat. The slots 15*a* and 20*a* enable the front plate 15 and the back plate 20 to absorb the impact of any projectile that impacts the armor apparatus 10, allowing the projectile to be more easily absorbed and withstood by the protected substrate and/or the armor apparatus 10. The sizes of the slots 15*a* and 20*a* can be modified or customized to be smaller than the size(s) of an expected projectile(s) that the armor apparatus 10 may be expected to encounter. The presence of the slots 15*a* and 20*a* encourage the projectile to fragment upon impact of the armor apparatus 10. Additionally, the slots 15*a* and 20*a* reduce the weight of the armor apparatus 10, without reducing its effectiveness. In several exemplary embodiments, the use of slots 15*a* and 20*a* that extend perpendicularly to the front plate 15 and the back plate 20, respectively, reduces manufacturing costs and reduces the amount of consumables used during the manufacturing process. In several exemplary embodiments, the armor apparatus 10 may be implemented in, modified for, or otherwise adapted for use in, a wide variety of applications including, but not limited to, body armor applications, military vehicle applications, commercial vehicle applications, and fortified structures.

In another embodiment, as illustrated in FIGS. 7, 8, 9, 10, and 11, an armor apparatus is generally referred to by the reference numeral 65 and includes a front plate 70, a middle plate 75, and a back plate 80. In an exemplary embodiment, the front plate 70 is connected to the middle plate 75 and the middle plate 75 is connected to the back plate 80.

In an exemplary embodiment, the front plate 70 is substantially identical to the front plate 15 therefore the front plate 70 will not be described in further detail. Reference numerals used to refer to the features of the front plate 15 that are substantially identical to the features of the front plate 70 will correspond to the reference numerals used to refer to the features of the front plate 15 except that the prefix for the reference numerals used to refer to the features of the front plate 15, that is, 15, will be replaced by the prefix of the front plate 70, that is, 70. In an exemplary embodiment, the length 70*b* is approximately 4.25 inches, the height 70*c* is approximately 4.25 inches, and the depth 70*d* is approximately 0.25 inches. In one embodiment, each of the slots 70*a* is oblong in shape and has a length of approximately 0.875 inches and a height of approximately 0.25 inches. In alternative embodiments, the slots 70*a* may have any dimension or shape such as, for example, a circular, a rectangular, an oval, or an oblong shape. In an exemplary embodiment, each of the slots 70*a* has a center axis 70*a*' (shown in FIG. 11) that is perpendicular to a front face 70*e* of the front plate 70. In one embodiment, the plurality of slots 70*a* are formed within the front plate 70 in a pattern that is identical to the pattern formed within the front plate 15. For example and in one embodiment, thirty-one (31) slots 70*a* are formed within the front plate 70, which has an area of about 18 square inches. Within the area of about 18 square inches, the thirty-one (31) slots 70*a* are arranged in 9 rows, such that a first, third, fifth, and seventh row (with the first row towards the top of the front plate 70) contain three (3) slots 70*a* and a second, fourth, sixth, and eight row contain four (4) slots 70*a*. Along the length 70*b*, the horizontal spacing between any two adjacent slots 70*a* is uniform while along the height 70*c*, the vertical spacing between any two adjacent rows is uniform. In an exemplary embodiment, respective lower surfaces defined by the slots 70*a* that are located on the ninth row extend along the length 70*b*, and also extend within the reference plane 30 (shown in FIGS. 7 and 8). If the area is greater than about 18 square inches, the pattern may be repeated and if the area is less than about 18 square inches, the number of rows or the amount of slots included in each row may be reduced. That is, the number of slots and rows may be added or removed from the pattern to accommodate different dimensions of the front plate 70.

In an exemplary embodiment, the middle plate 75 is substantially identical to the back plate 20 therefore the middle plate 75 will not be described in further detail. Reference numerals used to refer to the features of the back plate 20 that are substantially identical to the features of the middle plate 75 will correspond to the reference numerals used to refer to the features of the back plate 20 except that the prefix for the reference numerals used to refer to the features of the back plate 20, that is, 20, will be replaced by the prefix of the middle plate 75, that is, 75. In an exemplary embodiment, the length 75*b* is approximately 4.25 inches, the height 75*c* is approximately 4.25 inches, and the depth 75*d* is approximately 0.1875 inches. In an exemplary embodiment, each of the slots 75*a* has a center axis 75*a*' (shown in FIG. 11) that is perpendicular to a back face of the middle plate 75. That is, a surface forming each slot in the plurality of slots 75*a* forms a right angle with the back face of the middle plate 75. In one embodiment, the slots 75*a* are formed in the middle plate 75 in a pattern. In an exemplary embodiment, the pattern formed by the slots 75*a* within the middle plate 75 is identical to the pattern formed within the front plate 70. Accordingly, the pattern formed in the middle plate 75 includes thirty-one (31) slots 75*a* that are arranged in 9 rows, such that a first, third, fifth, and seventh row (with the first row towards the top of the middle plate 75) contain three (3) slots 75*a* and a second, fourth, sixth, and eight row contain four (4) slots 75*a*. However, and in an exemplary embodiment, a lower surface of the slots 75*a* that is located on the ninth row and that extends along the length 75*a* is offset from the plane of reference 30 by an offset distance 85. In an exemplary embodiment, the offset distance is 0.083 inches.

In an exemplary embodiment, the back plate 80 is substantially identical to the back plate 20 therefore the back plate 80 will not be described in further detail. Reference numerals used to refer to the features of the back plate 20 that are substantially identical to the features of the back plate 80 will correspond to the reference numerals used to refer to the features of the back plate 20 except that the prefix for the reference numerals used to refer to the features of the back plate 20, that is, 20, will be replaced by the prefix of the back plate 80, that is, 80. In an exemplary embodiment, the length 80*b* is approximately 4.25 inches, the height 80*c* is approximately 4.25 inches, and the depth 80*d* is approximately 0.1875 inches. In an exemplary embodiment, each of the slots 80*a* has a center axis 80*a*' (shown in FIG. 11) that is perpendicular to a back face 80*e* of the back plate 80. That is, a surface forming each slot in the plurality of slots 80*a* forms a right angle with the back face 80*e* of the back plate 80. In one embodiment, the slots 80*a* are formed in the back plate 80 in a pattern. In an exemplary embodiment, the pattern formed by the slots 80*a* within the back plate 80 is identical to the pattern formed within the front plate 70 and the pattern formed within the middle plate 75. Accordingly, the pattern formed in the back plate 80 includes thirty-one (31) slots 80*a* that are arranged in 9 rows, such that a first, third, fifth, and seventh row contain three (3) slots 80*a* and a second, fourth, sixth, and eight row contain four (4) slots 80*a*. However, and in an exemplary embodiment, a lower surface of the slots 80*a* that is located on the ninth row and that extends along the length 80*a* is offset from the plane of reference 30 by an offset distance 90. In an exemplary embodiment, the offset distance is 0.166. In an exemplary embodiment, the lower surface of the slots 80*a* that is located on the ninth row is offset from the lower surface of the slots 75*a* that is located on the ninth row by an offset distance 92, which is the generally the offset distance 90 divided by two. However, the offset distance 92 may be any value.

Figure 8:
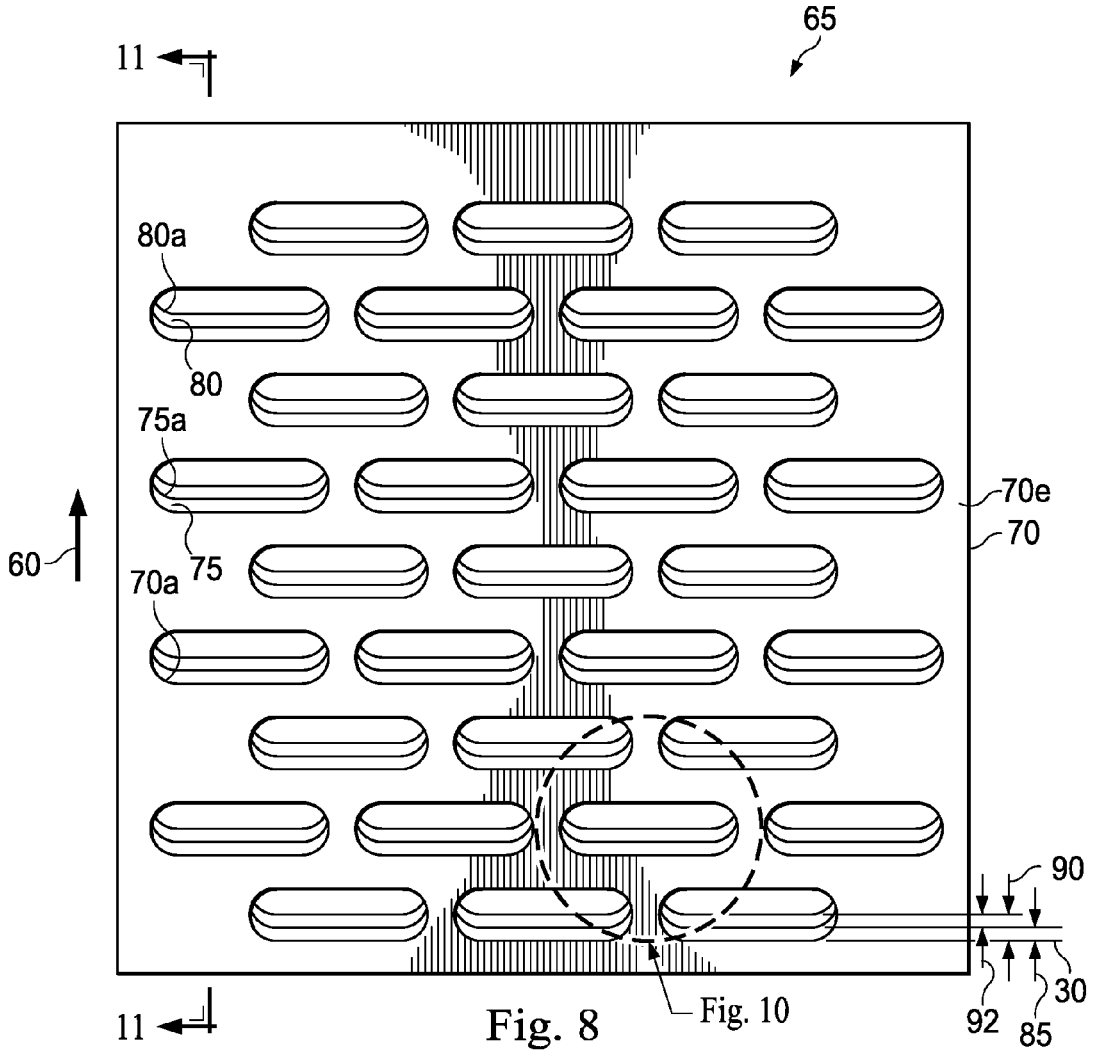
FIG. 8 is a front view of the armor apparatus of FIG. 7, according to an exemplary embodiment.
Figure 9:
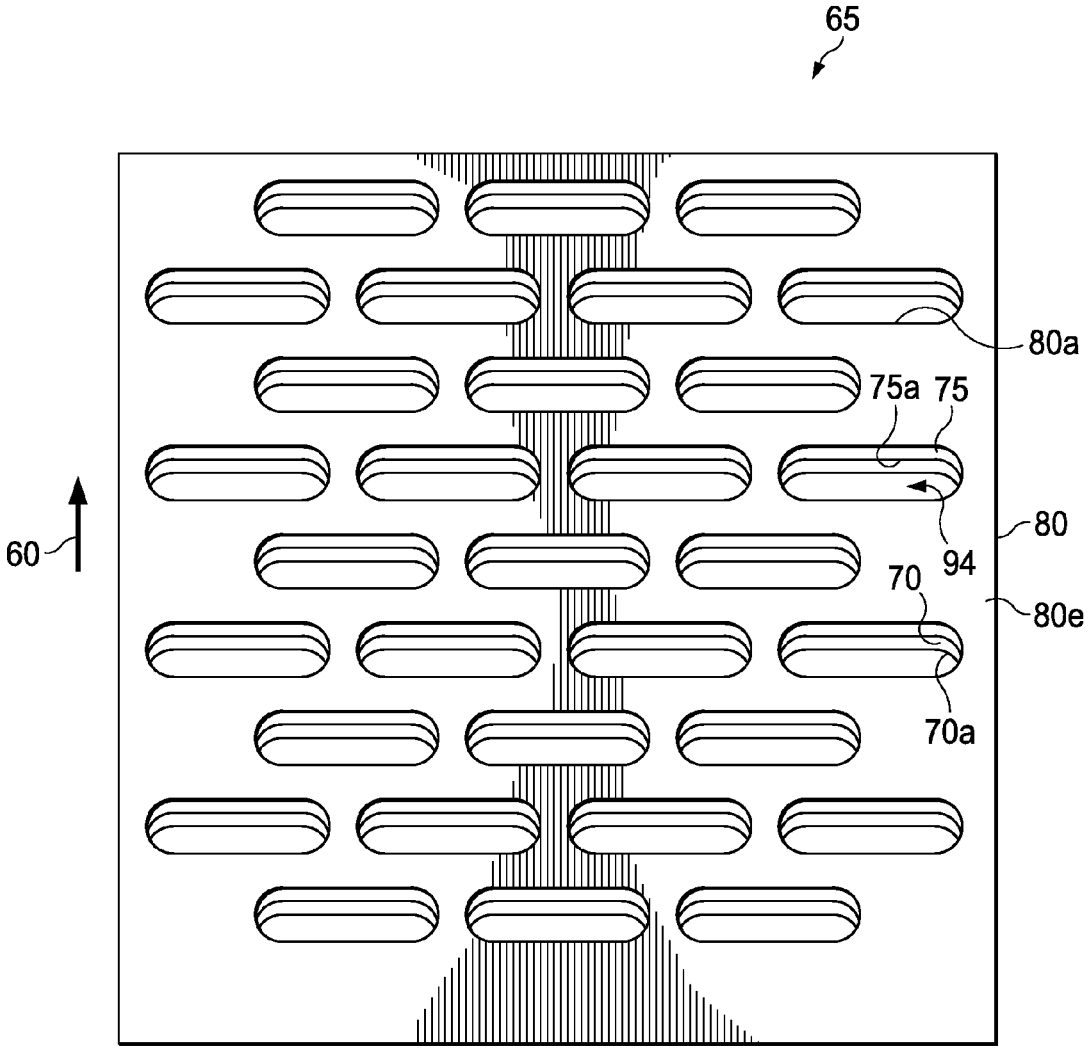
FIG. 9 is a back view of the armor apparatus of FIGS. 7 and 8, according to an exemplary embodiment.
Figure 10:
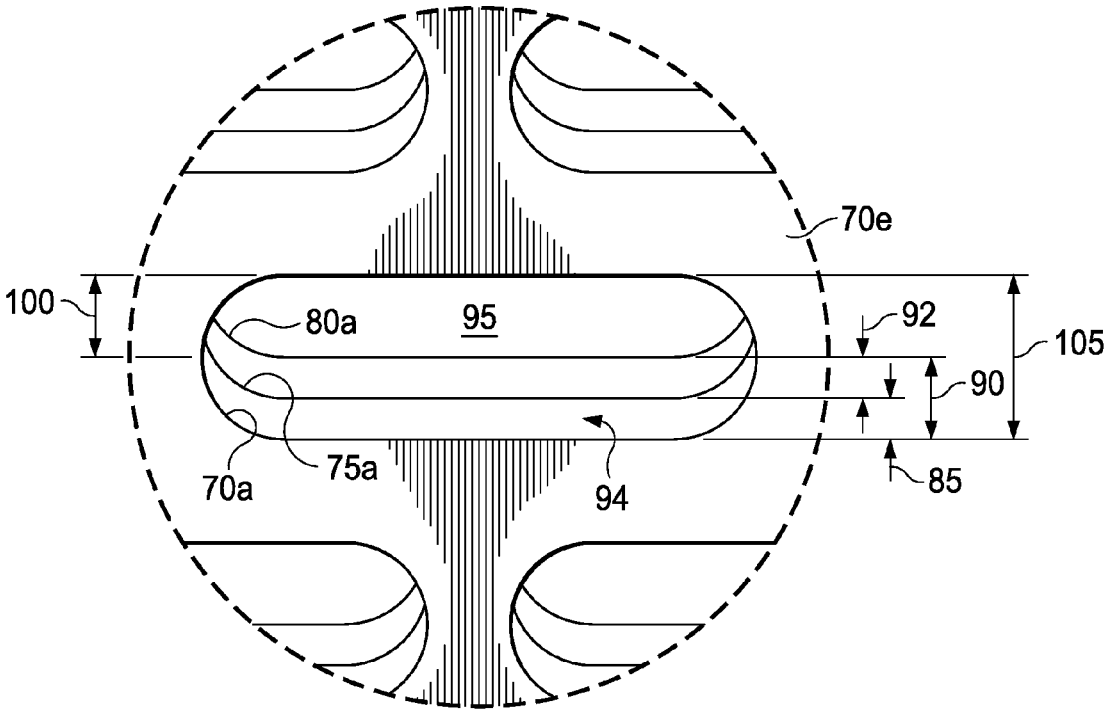
FIG. 10 is an enlarged view of a portion of FIG. 8, according to an exemplary embodiment.
Figure 11:
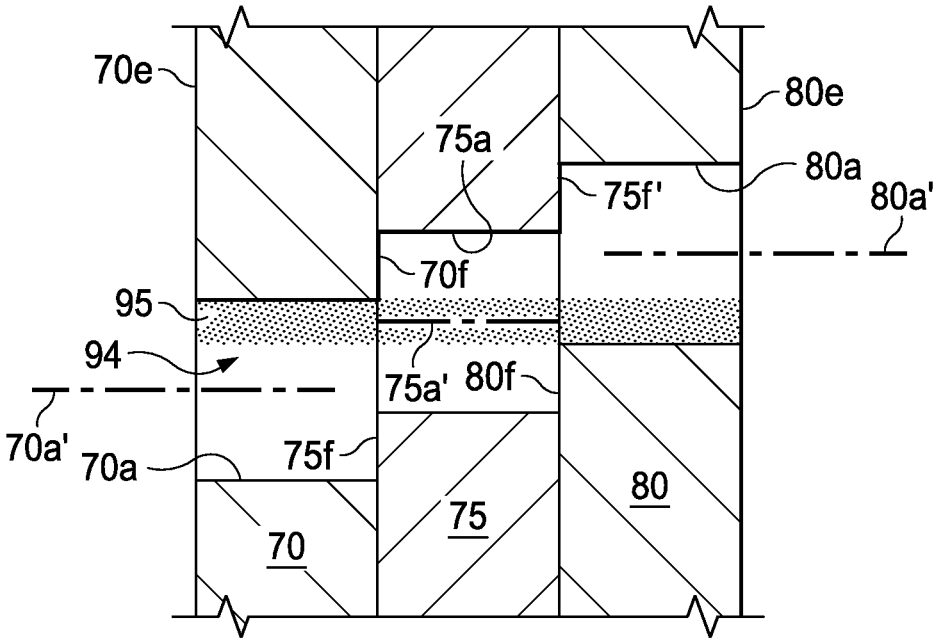
FIG. 11 is portion of a sectional view of the armor apparatus of FIGS. 7-10 taken along line 11-11 of FIG. 8, according to an exemplary embodiment.

As shown in FIGS. 7, 8, 9, 10, and 11 the slots 70*a* of the front plate 70 are partially aligned with corresponding slots in the plurality of slots 75*a* on the middle plate 75 and the slots 75*a* are partially aligned with corresponding slots in the plurality of slots 80*a* on the back plate 80 to form openings 94. In an exemplary embodiment, one of the openings 94 has a passage 95 (indicated by a shaded area 95 in FIG. 11) that extends through the front plate 70, the middle plate 75, and the back plate 80. In an exemplary embodiment, the passages 95 are longitudinally-extending passages. In an exemplary embodiment, a portion of the middle plate 75 extends over each of the slots 70*a* to form a plurality of first middle plate shoulders 75*f*. Similarly, a portion of the front plate 70*a* extends over each of the slots 75*a* to form a plurality of front plate shoulders 70*f*. In an exemplary embodiment, a portion of the back plate 80 extends over the slots 75*a* to form a plurality of back plate shoulders 80*f*. Similarly, a portion of the middle plate 75 extends over the slots 80*a* to form a plurality of second middle plate shoulders 75*g*. In an exemplary embodiment, the center axis 70*a*' of one slot in the plurality of slots 70*a* is parallel to and offset from the center axis 75*a*' of a corresponding one slot in the plurality of slots 75*a*, which is parallel to and offset from a center axis 80*a*' of a corresponding one slot in the plurality of slots 80*a*. In an exemplary embodiment and as shown in FIGS. 8 and 10, when the front plate 70, the middle plate 75 and the back plate 80 are connected, the passage 95 has a height 100. In certain embodiments, each of the slots 70*a*, 75*a*, and 80*a* has a height 105 of approximately 0.25 inches. As noted above, the offset 85 is 0.083 inches and the offset 90 is 0.166 inches. Therefore, each passage 95 has a height 100 of approximately 0.083 inches. Thus, the offsets 85 and 92 combined, or the offset 90 alone, is 67% of the height 100. In other words, the height 100 is approximately ⅓ of the height of the slots 70*a*, 75*a*, and 80*a*. In alternative embodiments, the height 100 and the offsets 85, 90, and 92 may have any variety of values. In alternative embodiments, the offsets 85, 90, and 92, together or alone, may be any percentage of the height 100 of slots 70*a*, 75*a*, and 80*a*, from greater than 0% to more than 100%. In connection with FIGS. 7, 8, 9, 10 and 11, the term "height" refers to any dimension along the direction indicated by the arrow 60. As shown in FIG. 11, when the front plate 70, the middle plate 75, and the back plate 80 are connected, at least one of the slots 70*a* partially aligns with a corresponding slot in the plurality of slots 75*a* that partially aligns with a corresponding slot in the plurality of slots 80*a* to form the opening 94 that has a stair-step profile. In an exemplary embodiment, one of the first middle plate shoulders 75*f* obstructs a portion of a corresponding one of the slots 70*a* and one of the back plate shoulders 80*f* obstructs a portion of a corresponding one of the slots 75*a* to form the stair-step profile. In an exemplary embodiment, one of the front plate shoulders 70*f* obstructs a portion of the corresponding one of the slots 75*a* and one of the second middle plate shoulders 70*f*' obstructs a portion of the corresponding one of the slots 80*a* to form the stair-step profile. In an exemplary embodiment, each of the shoulders 70*f*, 75*f*, 75*f*', and 80*f* is formed from right angles.

According to certain embodiments, the front plate 70 and the middle plate 75 are connected without the adhesive 25. Instead, the front plate 70 is braised to the middle plate 75. Additionally, the middle plate 75 is connected to the back plate 80 without the adhesive 25. Instead, the middle plate 75 is braised to the back plate 80. However, multiple methods of connecting the front plate 70 to the middle plate 75 and connecting the middle plate 75 to the back plate 80 may be used such as, for example, using fasteners, rivets, welding, etc. Thus, the disclosure is not limited to a particular configuration for connecting the front plate 70 to the middle plate 75 and for connecting the middle plate 75 to the back plate 80.

Figure 12:
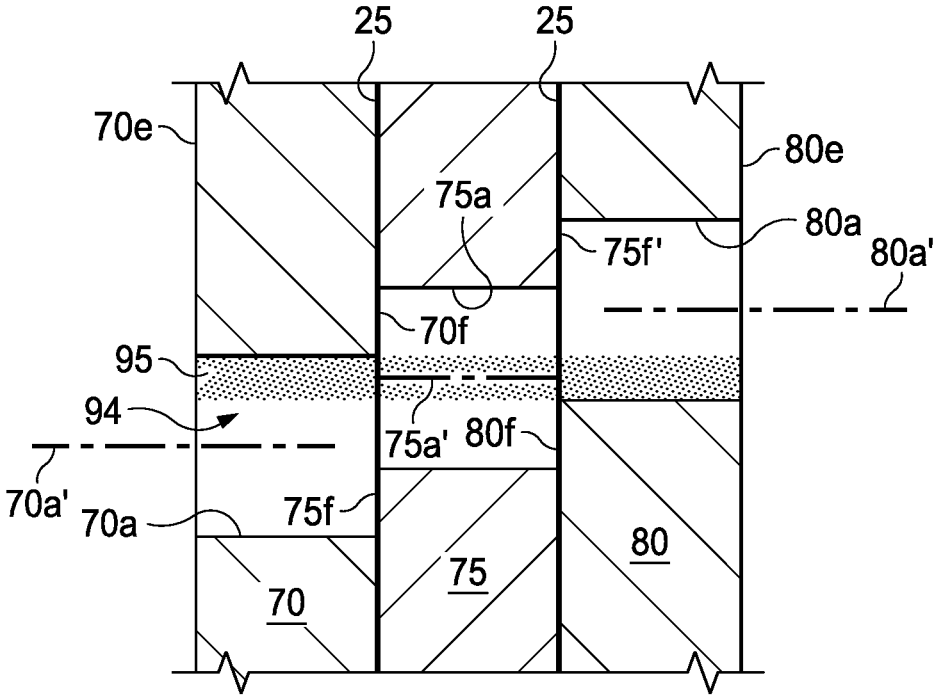
FIG. 12 is a portion of a sectional view of the armor apparatus of FIG. 7, according to another exemplary embodiment.

As shown in FIG. 12, which illustrates an alternate embodiment of the armor apparatus 65 illustrated in FIG. 11, the front plate 70 is connected to the middle plate 75 and the middle plate 75 is connected to the back plate 80 using the adhesive 25. In an exemplary embodiment, the adhesive 25 that adheres the front plate 70 to the middle plate 75 may be different from the adhesive 25 that adheres the middle plate 75 to the back plate 80. However, in several embodiments, the adhesive that adheres the front plate 70 to the middle plate 75 may be the same as the adhesive 25 that adheres the middle plate 75 to the back plate 80. Additionally, the front plate 70 may be adhered to the middle plate 75 using the adhesive 25 while the middle plate 75 is connected to the back plate 80 using another method such as, braising, welding, etc.

In operation, in several exemplary embodiments, the armor apparatus 65 operates to protect a structure or substrate (not shown) which may be exposed to a threat, such as a projectile (not shown). Substrates or structures suitable for protection include tanks, trucks, personal vehicles, airplanes, helicopters, boats, fortified structures, and humans. The armor apparatus 65 is placed over the substrate to be protected, and the armor apparatus 65 acts as a barrier between the substrate and the threat. The slots 70*a*, 75*a*, and 80*a* enable the front plate 70, the middle plate 75, and the back plate 80 to absorb the impact of any projectile that impacts the armor apparatus 65, allowing the projectile to be more easily absorbed and withstood by the protected substrate and/or the armor apparatus 65. The sizes of the slots 70*a*, 75*a*, and 80*a* can be modified or customized to be smaller than the size(s) of an expected projectile(s) that the armor apparatus 65 may be expected to encounter. The presence of the slots 70*a*, 75*a*, and 80*a* encourage the projectile to fragment upon impact of the armor apparatus 65. Additionally, the slots 70*a*, 75*a*, and 80*a* reduce the weight of the armor apparatus 65, without reducing its effectiveness. In several exemplary embodiments, the use of slots 70*a*, 75*a*, and 80*a* that extend perpendicularly to the front plate 70, the middle plate 75, and the back plate 80, respectively, reduces manufacturing costs and reduces the amount of consumables used during the manufacturing process. In several exemplary embodiments, the armor apparatus 65 may be implemented in, modified for, or otherwise adapted for use in, a wide variety of applications including, but not limited to, body armor applications, military vehicle applications, commercial vehicle applications, and fortified structures.

In an exemplary embodiment, the vertical offset 35 is created by vertically offsetting (not aligning the front plate 15 and the back plate 20 in the vertical direction) the front plate 15 from the back plate 20. However, in alternate embodiments, the vertical offset 35 is created by aligning the front plate 15 with the back plate 20 that has a pattern that is identical to the front plate 15 except that the pattern of the back plate 20 is vertically offset from the pattern of the front plate 15.

In an exemplary embodiment, the size and the shape of the slots in each of the plates 15 and 20 or plates 70, 75, and 80 are identical. However, in another embodiment, the size and the shape of the slots formed in each of the plates 15 and 20 or plates 70, 75, and 80 are not identical.

In an exemplary embodiment, the number of plates within the armor apparatus 10 and/or 65 may vary. While the armor apparatus 10 is shown having two plates (15 and 20) in FIGS. 1, 2, 3, 4, and 5, the armor apparatus 10 may have any number of plates. Additionally, the armor apparatus 65 may have any number of plates. Accordingly, the openings 39 and passages 40 extend through any number of plates. Additionally, and regardless of the number of plates used in each armor apparatus 10 and 65, the openings 39 and 94, respectively, form stair-step profiles.

In an exemplary embodiment, the armor apparatus 10 and/or 65 reduces the amount of rework and scrap from processing during the manufacturing process. Additionally, the armor apparatus 10 and/or 65 allows for a simplified manufacturing process, reduces the amount of manufacturing "rework", reduces the manufacturing scrap, and improves the material supply chain. In an exemplary embodiment, the armor apparatus 10 and/or 65 removes the limitation on the supply chain for green plate suitable for heat treating. In an exemplary embodiment, the armor apparatus 10 and/or 65 optimizes the strengths of various grades of steel armor.

In an exemplary embodiment, any one of the plates 15, 20, 70, 75, and 80 may be a solid plate without a plurality of slots. In an exemplary embodiment, an additional plate may be connected to or adhered to any one of the plates 15, 20, 70, 75, and 80 to assist in the fragmentation process and to increase the rigidity of the armor apparatus 10 and/or 65.

In an exemplary embodiment, the combination of the patterns, the size and shape of the slots, the thicknesses 15*d*, 20*d*, 70*d*, 75*d*, 80*d*, and/or 85*d*, the number of plates within the armor apparatus 10 and/or 65, and the grades of steel armor plate can be configured to address a specific threat level.

The present disclosure provides an apparatus that includes a first plate through which a first plurality of slots is formed; and a second plate connected to the first plate and through which a second plurality of slots is formed; wherein each slot in the first plurality of slots is aligned with a corresponding slot in the second plurality of slots to form a passage that extends through the first plate and the second plate; and wherein the first plate blocks a portion of each slot in the second plurality of slots and the second plate blocks a portion of each slot in the first plurality of slots. In an exemplary embodiment, the first plate has a back face and each slot in the first plurality of slots has a center axis that extends perpendicular to the back face of the first plate; and wherein the second plate has a front face and each slot in the second plurality of slots has a center axis that extends perpendicular to the front face of the second plate and parallel to the center axis of each slot in the first plurality of slots. In another exemplary embodiment, a back face of the first plate is adhered to a front face of the second plate. In an exemplary embodiment, a back face of the first plate is in contact with a front face of the second plate. In an exemplary embodiment, the first plurality of slots is formed in the first plate in a first pattern; the second plurality of slots is formed in the second plate in a second pattern; and the first pattern is the same as the second pattern. In an exemplary embodiment, the first pattern is offset from the second pattern. In an exemplary embodiment, the apparatus also a third plate connected to the second plate and through which a third plurality of slots is formed; wherein each slot in the third plurality of slots is aligned with a corresponding slot in the second plurality of slots so that the passage further extends through the third plate; and wherein the third plate blocks a portion of each slot in the second plurality of slots and the second plate blocks a portion of each slot in the third plurality of slots.

The present disclosure also provides a laminate armor apparatus that includes a first plate through which a first plurality of slots is formed in a first pattern; and a second plate through which a second plurality of slots is formed in a second pattern that is identical to the first pattern; wherein the first plate is connected to the second plate such that a back face of the first plate is in contact with or adhered to a front face of the second plate; and wherein at least one slot in the first plurality of slots intersects with at least one slot in the second plurality of slots to create an opening formed through the first plate, the opening having a stair-step profile. In an exemplary embodiment, a longitudinally-extending passage extends within the opening and through the first plate and the second plate. In an exemplary embodiment, a portion of the first plate blocks a portion of the at least one slot in the second plurality of slots and a portion of the second plate blocks a portion of the at least one slot in the first plurality of slots. In an exemplary embodiment, the passage has a height that is greater than a height of the portion of the first plate that blocks a portion of the at least one slot in the second plurality of slots. In an exemplary embodiment, the size and shape of the at least one slot in the first plurality of slots is identical to the size and shape of the at least one slot in the second plurality of slots. In an exemplary embodiment, the apparatus also includes a third plate through which a third plurality of slots is formed in a third pattern that is identical to the first pattern and the second pattern; and wherein the third plate is connected to the second plate such that a back face of the second plate is in contact with or adhered to a front face of the third plate; wherein at least one slot in the third plurality of slots intersects with at least one slot in the second plurality of slots and with at least one slot in the first plurality of slots; and wherein the opening is further formed through the third plate. In an exemplary embodiment, the passage further extends through the third plate. In an exemplary embodiment, each slot in the first plurality of slots has a center axis that extends perpendicular to the back face of the first plate; and each slot in the second plurality of slots has a center axis that extends perpendicular to the front face of the second plate and parallel to the center axis of each slot in the first plurality of slots. In an exemplary embodiment, the first pattern is offset from the second pattern.

The present disclosure also provides a method of protecting a structure, the method including connecting a first plate through which a first plurality of slots is formed in a first pattern to a second plate through which a second plurality of slots is formed in a second pattern that is identical to the first pattern such that: a back face of the first plate is in contact with or adhered to a front face of the second plate; and at least one slot in the first plurality of slots intersects with at least one slot in the second plurality of slots to create an opening formed through the first plate and the second plate, the opening having a stair-step profile; and placing the first plate and the second plate over the structure. In an exemplary embodiment, a longitudinally-extending passage extends within the opening and through the first plate and the second plate. In an exemplary embodiment, a portion of the first plate blocks a portion of the at least one slot in the second plurality of slots and a portion of the second plate blocks a portion of at least one slot in the first plurality of slots. In an exemplary embodiment, the size and shape of each slot in the first plurality of slots is identical to the size and shape of each slot in the second plurality of slots; and the first pattern is offset from the second pattern.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, or combined, at least in part, with one or more of the other elements and teachings of the various illustrative embodiments.

Any spatial references such as, for example, "height," "front," "back," "middle," "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, or one or more of the procedures may also be performed in different orders, simultaneously or sequentially. In several exemplary embodiments, the steps, processes or procedures may be merged into one or more steps, processes or procedures. In several exemplary embodiments, one or more of the operational steps in each embodiment may be omitted. Moreover, in some instances, some features of the present disclosure may be employed without a corresponding use of the other features. Moreover, one or more of the above-described embodiments or variations may be combined in whole or in part with any one or more of the other above-described embodiments or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

What is claimed is:

1. A laminate armor apparatus, comprising:

a first plate through which a first plurality of slots is formed; and a second plate connected to the first plate and through which a second plurality of slots is formed;

wherein each slot in the first plurality of slots is aligned with a corresponding slot in the second plurality of slots to form a passage that extends through the first plate and the second plate; and wherein the first plate blocks a portion of each slot in the second plurality of slots and the second plate blocks a portion of each slot in the first plurality of slots.

2. The laminate armor apparatus of claim 1, wherein the first plate has a back face and each slot in the first plurality of slots has a center axis that extends perpendicular to the back face of the first plate; and wherein the second plate has a front face and each slot in the second plurality of slots has a center axis that extends perpendicular to the front face of the second plate and parallel to the center axis of each slot in the first plurality of slots.

3. The laminate armor apparatus of claim 1, wherein a back face of the first plate is adhered to a front face of the second plate.

4. The laminate armor apparatus of claim 1, wherein a back face of the first plate is in contact with a front face of the second plate.

5. The laminate armor apparatus of claim 1, wherein the first plurality of slots is formed in the first plate in a first pattern;

wherein the second plurality of slots is formed in the second plate in a second pattern; and wherein the first pattern is the same as the second pattern.

6. The laminate armor apparatus of claim 5, wherein the first pattern is offset from the second pattern.

7. The laminate armor apparatus of claim 1, further comprising a third plate connected to the second plate and through which a third plurality of slots is formed;

wherein each slot in the third plurality of slots is aligned with a corresponding slot in the second plurality of slots so that the passage further extends through the third plate; and wherein the third plate blocks a portion of each slot in the second plurality of slots and the second plate blocks a portion of each slot in the third plurality of slots.

8. A laminate armor apparatus, comprising:

a first plate through which a first plurality of slots is formed in a first pattern; and a second plate through which a second plurality of slots is formed in a second pattern that is identical to the first pattern;

wherein the first plate is connected to the second plate such that a back face of the first plate is in contact with or adhered to a front face of the second plate;

wherein at least one slot in the first plurality of slots intersects with, and is offset by an offset distance from, at least one slot in the second plurality of slots to create an opening formed through at least the first plate and the second plate, the opening having a stair-step profile;

wherein the first plate is one of a number of plates creating the opening;

wherein the second plate is another of the number of plates creating the opening;

wherein the one slot in the first plurality of slots has a slot height; and wherein the offset distance is a function of the slot height and the number of plates.

9. The laminate armor apparatus of claim 8, wherein a longitudinally-extending passage extends within the opening and through the first plate and the second plate.

10. The laminate armor apparatus of claim 9, wherein a portion of the first plate blocks a portion of the at least one slot in the second plurality of slots and a portion of the second plate blocks a portion of the at least one slot in the first plurality of slots.

11. The laminate armor apparatus of claim 10, wherein the passage has a height that is greater than a height of the portion of the first plate that blocks a portion of the at least one slot in the second plurality of slots.

12. The laminate armor apparatus of claim 8, wherein the size and shape of the at least one slot in the first plurality of slots is identical to the size and shape of the at least one slot in the second plurality of slots.

13. The laminate armor apparatus of claim 8, further comprising a third plate through which a third plurality of slots is formed in a third pattern that is identical to the first pattern and the second pattern; and wherein the third plate is connected to the second plate such that a back face of the second plate is in contact with or adhered to a front face of the third plate;

wherein at least one slot in the third plurality of slots intersects with at least one slot in the second plurality of slots and with at least one slot in the first plurality of slots; and wherein the opening is further formed through the third plate.

14. The laminate armor apparatus of claim 13, wherein the passage further extends through the third plate.

15. The laminate armor apparatus of claim 8, wherein each slot in the first plurality of slots has a center axis that extends perpendicular to the back face of the first plate; and each slot in the second plurality of slots has a center axis that extends perpendicular to the front face of the second plate and parallel to the center axis of each slot in the first plurality of slots.

16. The laminate armor apparatus of claim 8, wherein the first pattern is offset from the second pattern.

17. A method of protecting a structure, the method comprising:

connecting a first plate through which a first plurality of slots is formed in a first pattern to a second plate through which a second plurality of slots is formed in a second pattern that is identical to the first pattern such that:

a back face of the first plate is in contact with or adhered to a front face of the second plate; and at least one slot in the first plurality of slots intersects with, and is offset by an offset distance from, at least one slot in the second plurality of slots to create an opening formed through at least the first plate and the second plate, the opening having a stair-step profile; and placing the first plate and the second plate over the structure;

wherein the first plate is one of a number of plates creating the opening;

wherein the second plate is another of the number of plates creating the opening;

wherein the one slot in the first plurality of slots has a slot height; and wherein the offset distance is a function of the slot height and the number of plates.

18. The method of claim 17, wherein a longitudinally-extending passage extends within the opening and through the first plate and the second plate.

19. The method of claim 17, wherein a portion of the first plate blocks a portion of the at least one slot in the second plurality of slots and a portion of the second plate blocks a portion of at least one slot in the first plurality of slots.

20. The method of claim 17, wherein the size and shape of each slot in the first plurality of slots is identical to the size and shape of each slot in the second plurality of slots; and wherein the first pattern is offset from the second pattern.

21. The laminate armor apparatus of claim 8, wherein the offset distance is equal to the slot height divided by the number of plates.

22. The laminate armor apparatus of claim 8, wherein the number of plates is two; and wherein the offset distance is equal to the slot height divided by two.

23. The laminate armor apparatus of claim 8, wherein the number of plates is three; and wherein the offset distance is equal to the slot height divided by three.

24. The laminate armor apparatus of claim 8, wherein the opening is at least partially filled with an adhesive.

25. The method of claim 17, wherein the offset distance is equal to the slot height divided by the number of plates.

26. The method of claim 17, wherein the number of plates is two; and wherein the offset distance is equal to the slot height divided by two.

27. The method of claim 17, wherein the number of plates is three; and wherein the offset distance is equal to the slot height divided by three.

28. The method of claim 17, wherein the opening is at least partially filled with an adhesive.

* * * * *